US007686538B2

(12) United States Patent
Lutz et al.

(10) Patent No.: US 7,686,538 B2
(45) Date of Patent: Mar. 30, 2010

(54) PORTABLE VIBRATORY SCREED WITH BUBBLE VIAL INCLINATION INDICATION SYSTEM

(75) Inventors: Todd J. Lutz, Oconomowoc, WI (US); Richard D. Goldberg, Hartford, WI (US); Darrin W. Dauffenbach, Pewaukee, WI (US); Timothy J. Lickel, Oconomowoc, WI (US)

(73) Assignee: Wacker Neuson Corporation, Menomonee Falls, WI (US)

( * ) Notice: Subject to any disclaimer, the term of this patent is extended or adjusted under 35 U.S.C. 154(b) by 0 days.

(21) Appl. No.: 11/763,239

(22) Filed: Jun. 14, 2007

(65) Prior Publication Data

US 2007/0292208 A1 Dec. 20, 2007

Related U.S. Application Data

(60) Provisional application No. 60/804,847, filed on Jun. 15, 2006.

(51) Int. Cl.
*E01C 19/38* (2006.01)

(52) U.S. Cl. ..... 404/114

(58) Field of Classification Search ..... 404/114, 404/118, 84.5, 84.05, 133.1, 84.1
See application file for complete search history.

(56) References Cited

U.S. PATENT DOCUMENTS

| | | | | | |
|---|---|---|---|---|---|
| 3,747,687 | A * | 7/1973 | Bodine | 172/40 |
| 3,845,827 | A * | 11/1974 | Schulin | 173/162.1 |
| 4,113,403 | A * | 9/1978 | Tertinek et al. | 404/113 |
| 4,670,985 | A * | 6/1987 | Biersteker | 30/381 |
| 4,752,156 | A * | 6/1988 | Owens | 404/118 |
| 4,782,822 | A * | 11/1988 | Ricken | 601/62 |
| 4,838,730 | A * | 6/1989 | Owens | 404/114 |
| 5,190,401 | A * | 3/1993 | Wilson | 404/118 |
| 5,244,305 | A * | 9/1993 | Lindley | 404/97 |
| 5,857,803 | A * | 1/1999 | Davis et al. | 404/102 |
| 6,089,787 | A * | 7/2000 | Allen et al. | 404/118 |
| 6,139,217 | A * | 10/2000 | Reuter | 404/97 |
| 6,322,286 | B1 * | 11/2001 | Rijkers | 404/114 |
| 6,374,569 | B1 * | 4/2002 | Suckow | 52/749.13 |
| 6,758,631 | B2 * | 7/2004 | Frankeny, II | 404/118 |
| 6,976,805 | B2 * | 12/2005 | Quenzi et al. | 404/114 |
| 6,981,819 | B1 * | 1/2006 | Suckow et al. | 404/114 |
| 7,293,938 | B1 * | 11/2007 | Suckow et al. | 404/114 |
| 7,357,596 | B2 * | 4/2008 | Face et al. | 404/118 |
| 2002/0102134 | A1 * | 8/2002 | Piccoli | 404/114 |
| 2005/0100407 | A1 * | 5/2005 | Sina | 404/114 |
| 2005/0158121 | A1 * | 7/2005 | Lindley | 404/114 |
| 2006/0018714 | A1 * | 1/2006 | Rouillard | 404/114 |

* cited by examiner

*Primary Examiner*—Gary S Hartmann
(74) *Attorney, Agent, or Firm*—Boyle Fredrickson, S.C.

(57) ABSTRACT

A portable vibratory screed includes a blade that is connected to a handle constructed to be manipulated by an operator. Nodes of minimum vibrational amplitude are formed at specific locations along the length of the blade when the exciter is driven at a rated operating speed. A site level and/or the handle is attached to the blade at or in the vicinity of one or more of these nodes, therefore, is relatively isolated from induced vibrations.

18 Claims, 9 Drawing Sheets

PORTABLE VIBRATORY SCREED WITH BUBBLE VIAL INCLINATION INDICATION SYSTEM

CROSS-REFERENCE TO RELATED APPLICATION

This application claims priority to U.S. Provisional Patent Application Ser. No. 60/804,847, filed on Jun. 15, 2006 titled "Portable Vibratory Screed", the disclosure of which is incorporated herein.

FIELD OF THE INVENTION

The present invention relates generally to screeds for leveling concrete, and more particularly, to a portable vibratory screed having vibration sensitive components, such as an economical inclination indication system and/or handles, positioned so as to be relatively immune to vibrations generated during screed operation. The screed may include a robust blade construction instead of or in addition to having vibration immunizing component positioning.

BACKGROUND OF THE INVENTION

During a concrete pouring process, a material that includes aggregates, cement, and water is poured into an area that may be bounded by forms to contain the concrete material. As concrete is delivered into the pour area, a plurality of laborers, often called "puddlers," using tools such as rakes, come-alongs, and/or shovels, approximate a uniform distribution of the concrete material to the desired elevation. Still other laborers, commonly equipped with a piece of lumber or other straight member referred to as a "strike-off," move the strike-off across the concrete material. The process of manually striking-off the concrete material consolidates the material and forces the larger aggregate below the finished elevation. It also shapes the surfaces of the concrete to the desired slope or "grade." The flatness of the finished surface is highly dependant on the skill of the personnel handling the strike-offs. Additionally, manually striking-off the concrete material is very labor intensive and requires a great deal of skill and experience to ensure a flat and properly inclined finished surface.

The advent of the portable vibratory screed greatly reduced the labor associated with leveling of the concrete material. Portable vibratory screeds commonly include a vibration-inducing mechanism attached to a board or blade and one or more handles that extends from the blade. The vibration mechanism typically comprises an "exciter" formed from one or more eccentric weights driven by a motor. Operation of the vibration mechanism consolidates the concrete material such that, as the blade is moved across the wet concrete, the vibrating blade forces the larger aggregate below the surface of the material and works a highly cementatious material with smaller aggregates, often called "cream," to the finish surface of the material. Operator manipulation of the handle, as well as the rigidity of the blade, directly affects the flatness and inclination of the finished surface of the material. Accordingly, an operator's ability to control the pitch or tilt of the blade as well as the speed and direction of travel of the blade determines the flatness of the finished material.

To reduce the transmission of vibrations to the operator's hands from the vibration mechanism, an isolation mechanism, such as a rubber bushing, is commonly disposed between the end of the handle and the blade. However, the isolation mechanism provides an undesirable response to handle movement during operation because the isolation mechanism distorts upon handle movement so that only a portion of the effect of the handle's motion is translated to the blade. Accordingly, the isolation mechanism detrimentally affects the operator's ability to control the position of the blade.

The elevation of the finished material is also commonly determined by the operator's visual inspection of the finish elevation in relation to the elevation references such as the forms. Although portable vibratory screed assemblies are known which include various inclination indication systems, such systems are commonly directed to targeted users. Many inclination and elevation systems include laser systems. However, many such systems fail to address the positioning of the handle, and thereby the pitch of the blade, relative to the bottom surface of the blade. As such, such laser elevation systems are only somewhat successful at properly indicating to the operator the direction the handle should be moved to acquire an elevation and/or pitch that is consistent with the desired elevation. Additionally, the laser elevation and inclination systems are costly to integrate into a screed. From a manufacturing perspective, these costs are commonly deferred to the customer as well as the costs associated with the service and maintenance requirements of such systems.

Others, such as the system disclosed in U.S. Pat. No. 4,752,156, have relatively inexpensive inclinators, such as a site level, for indicating the orientation of the screed plate. A site level, often known as a bubble vial, is formed from a glass tube having a bubble encased in a liquid. The bubble is centered in the vial when the vial is horizontal and rises toward one end or the other if the vial is inclined relative to the movement. However, as discussed in U.S. Pat. No. 6,758,631 the '631 patent, such indicators have been less than successful at indicating the inclination of the blade of the screed during operation of an exciter assembly. That is, vibrations generated by operation of the exciter assembly propagate to the bubble vial and obliterate the bubble of the site level, rendering it useless. The '631 patent concludes that bubble vials or site levels are unacceptable for screed inclination indication during screeding.

SUMMARY OF THE INVENTION

In accordance with one aspect of the invention, at least one of an operator's handle and a site level is mounted on the plate of a portable vibratory screed at or near a node where the amplitude of the induced vibrations is a minimum when the exciter is driven at a designated operating speed such as the rated driven speed of the exciter, hence largely isolating that component from vibrations that could otherwise provide discomfort to the operator or break up the bubble in a site level.

The blade of the screed may be configured to minimize twisting or bending along its length. Such a construction provides for a substantially uniform and flat finished surface and also provides for high responsiveness to operator manipulation of the screed's handle. This effect is achieved by providing the blade with a cross-sectional shape that rigidities the screed. For instance, the blade may be generally b-shaped when seen in transverse cross section.

Another aspect of the invention discloses a method of forming a portable screed that includes providing a blade constructed to receive an exciter assembly. Nodes of minimum vibrational amplitude are formed along a length of the blade at specific locations when the exciter is driven at a designated speed, and at least one of an operator's handle and a site level is supported on the blade at or in the vicinity of one of those nodes.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention. In the drawings.

DETAILED DESCRIPTION OF THE PREFERRED EMBODIMENTS

Figure 1:
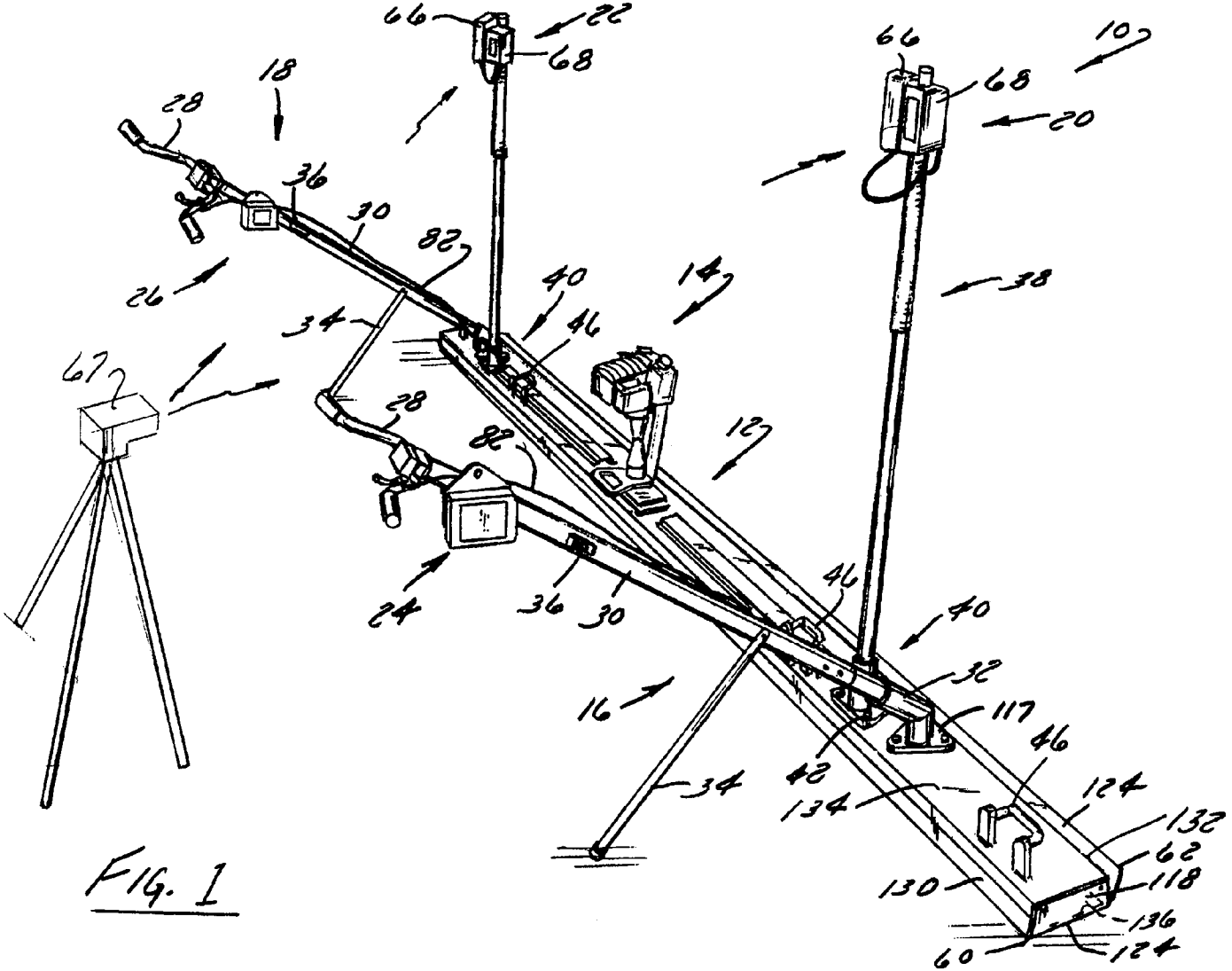
FIG. 1 is an isometric view of a portable vibratory screed according to one embodiment of the present invention.

FIG. 1 shows a portable vibratory screed 10 according to a one embodiment of the present invention. Portable vibratory screed 10 includes a board or blade 12 having a vibration mechanism 14 attached thereto. A first operator station 16 and a second operator station 18 are connected to blade 12. In one embodiment, operation stations 16, 18 each include a laser leveling system 20, 22 and a handle assembly 24, 26. Understandably, although two operator stations are shown, screed 10 could be provided in a single operator configuration which would include a single handle assemble positioned proximate a lengthwise center of blade 12. Each handle assembly 24, 26 includes a handlebar 28 constructed to be engaged by an operator. A handle tube 30 extends between handlebar 28 and blade 12. The handle tube 30 is rigidly connected directly to the blade 12 by a handle mount bracket 32. A kickstand 34 is pivotably connected to each handle tube 30 and maintains portable vibratory screed 10 in a generally upright or operative position when not in use. A clip 36 is attached to each handle tube 30 and is constructed to receive kickstand 34 therein during operation of the portable vibratory screed 10 such that kickstand 34 is clear of the concrete material during a concrete leveling process.

Blade 12 is constructed to resist bending and/or twisting of the blade along its length. Such a construction provides for a substantially uniform and flat finished surface and a portable vibratory screed 10 that is highly responsive to operator manipulation of a handle thereof. This effect is achieved by providing the blade 10 with a cross-sectional shape that rigidifies the blade. The blade, for instance, may include at least a portion, preferably leading portion when viewed in the direction of normal use (toward the operator), that is reinforced by providing a reinforcing plate or plates on top of a bottom plate of the blade in a spaced apart relationship from the bottom plate. The reinforcing plate(s) may extend the entire length of the blade or may be provided in a number of discrete segments. In the present embodiment, the blade 12 is generally b-shaped when seen in cross section. It is formed from extruded aluminum and includes a bottom plate 124 extending the entire width 137 (FIG. 8) of the blade 12 and a top, reinforced section located over approximately the leading half of the bottom plate 124. The trailing portion of bottom plate 124 may be either planer, curved, or inclined. The reinforced section includes first and second longitudinally extending, transversely spaced walls 130, 132 that extend upwardly from the bottom plate. Wall 130 is oriented proximate leading edge 60 of blade 12, whereas wall 132 is disposed along mid-way between wall 130 and trailing edge 62 of blade 12. An upper plate 134 extends between walls 130 and 132 and encloses a cavity 136 between upper wall 134, pair of walls 130, 132, and the bottom plate 124. The "b-shaped" cross-section 56 could be formed by the combination of any of constituent parts having at least generally rectangular and L-shaped cross-sections, a U and an L-shaped cross-section, a T and an L-shaped cross-section, or a single unitary extrusion having such a shape. Other configurations are also contemplated, so as to provide the requisite stiffening.

Figure 8:
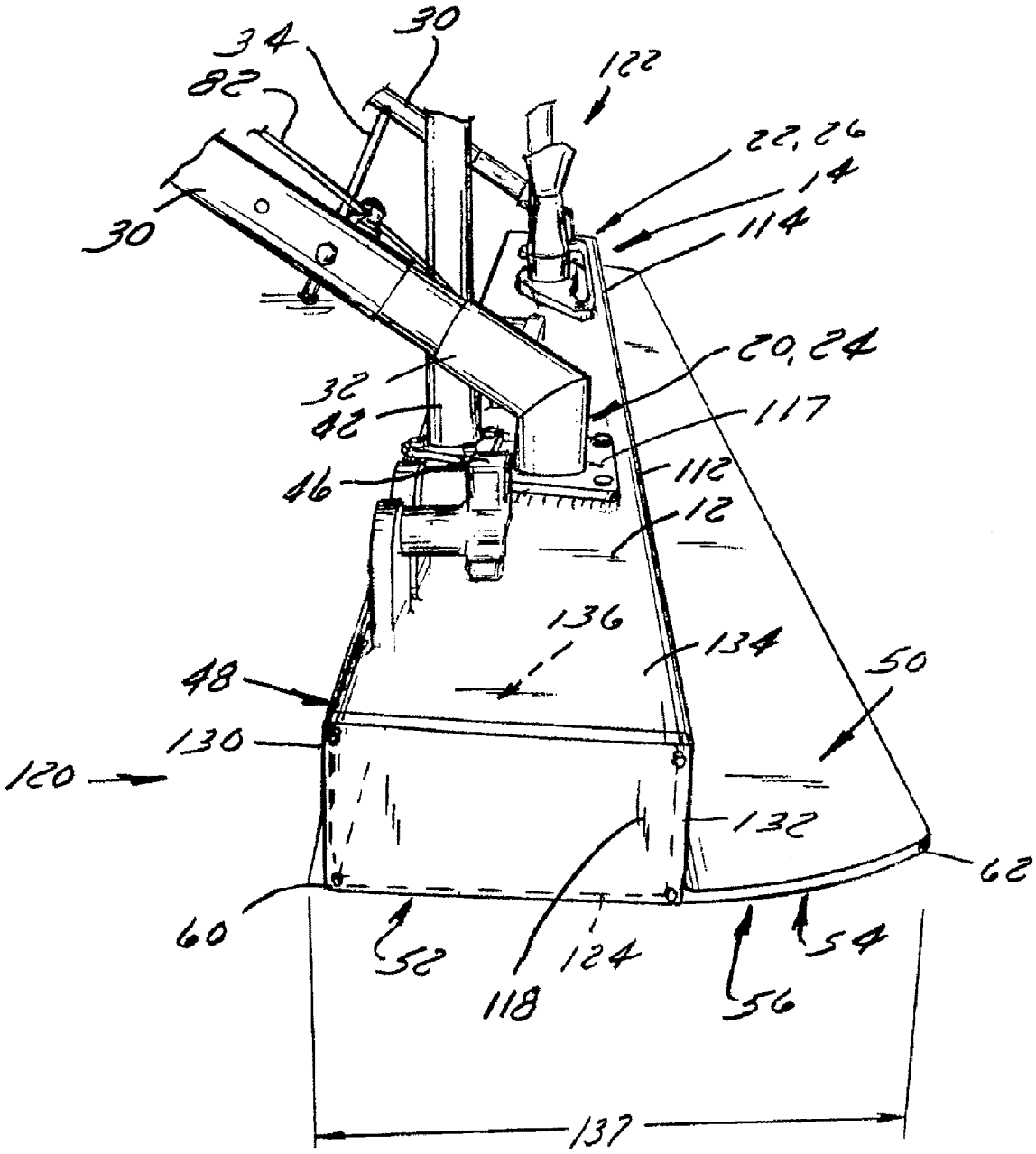
FIG. 8 is a side elevational view of an end of the portable vibratory screed shown in FIG. 1.

As shown in FIG. 8, an end plate 118 is connected to each end 120, 122 of blade 12. End plate 118 encloses a generally rectangular cavity 136 and, thus, ensures that the material being screeded is not deposited within cavities of portable vibratory screed 10. Also as shown in FIG. 8, handle mount brackets 32 and mast mounts 42 may be offset from one another along a width 137 of blade 12. Handle mount brackets 32 of handle assemblies 24, 26 are generally aligned along width 137 and mast mount 42 of laser leveling system 20, 22 are also aligned along width 137 of blade 12. Handle mount bracket 32 of handle assemblies 24, 26 and mast mount 42 of laser leveling system 20, 22 can be positioned anywhere along upper wall 134 width 137 of blade 12 while maintaining the nodal location of the mount assemblies.

Figure 9:
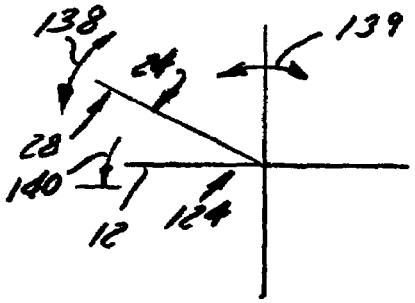
FIG. 9 is a graphic representation showing the pitch operation of the portable vibratory screed shown in FIG. 1.
Figure 10:
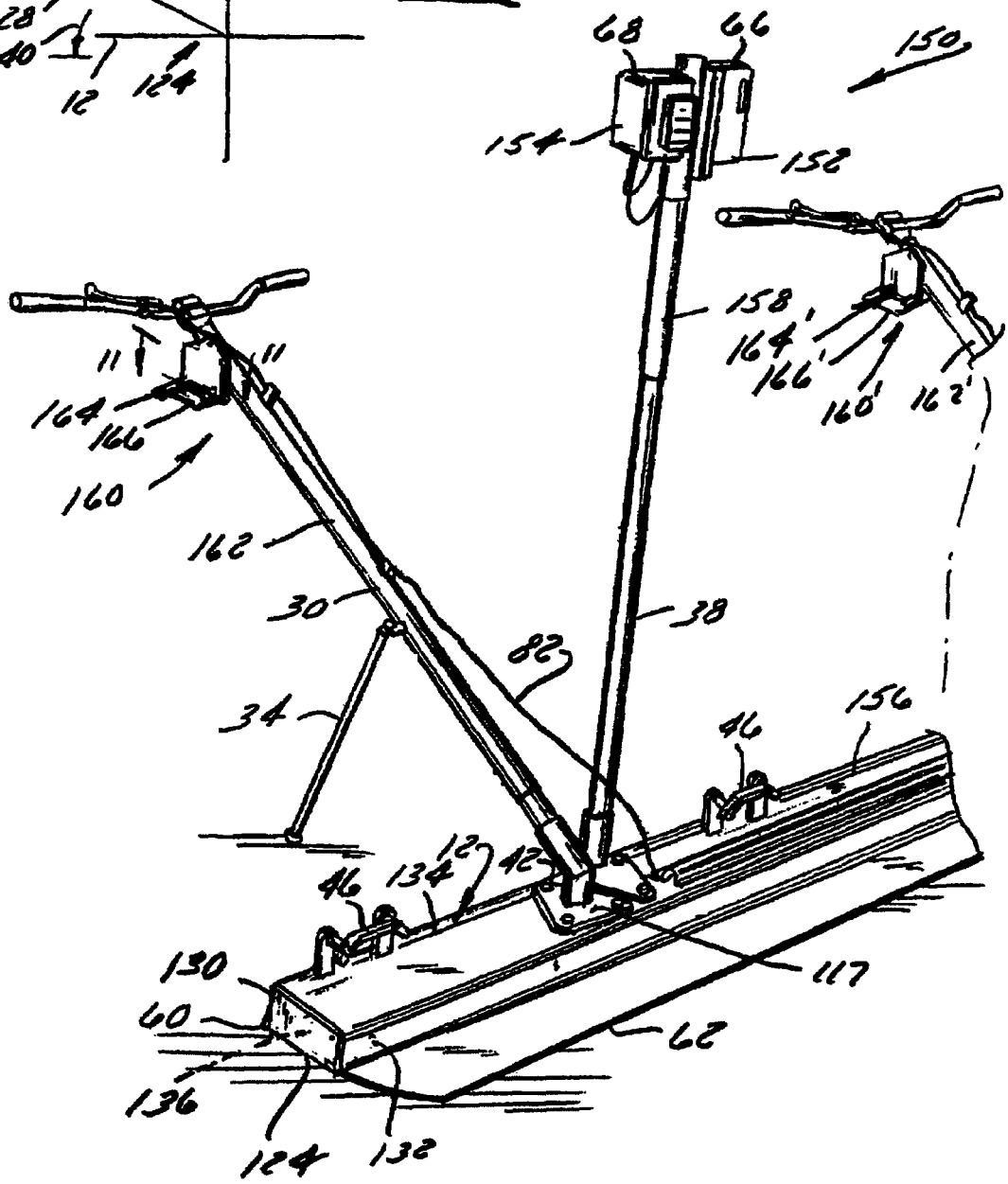
FIGS. 10-12 show an alternate embodiment of a portable screed according to the present invention, equipped with a site level-based inclination indication system.

FIGS. 9 and 10 show the bending and twisting resistance of blade 12. As graphically shown in FIG. 9, an operator 138 of handlebar 28 can maintain side 124 of blade 12 relatively flat to a rigid surface 140 by manipulation of handlebar 28. Referring to FIGS. 8 and 9, operator 138 manipulation of handlebar 28 in a clockwise direction, creates a generally uniform spacing between leading edge 60 and surface 140 along length 110 (FIG. 7) of blade 12. Accordingly, blade 12 is constructed to resist torsional and bending forces inflicted thereupon. Such a construction ensures that the majority of blade 12 is responsive to operator manipulation of handlebars 28.

As compared to prior known blade constructions marketed commercially by Wacker Corporation and Magic Screed, a blade constructed as shown and described herein provides the following enhanced operational parameters:

TABLE 1

| | Prototype Blade | Wacker Corporation Standard Blade | Wacker Corporation Wide Blade | Magic Screed Blade |
|---|---|---|---|---|
| Mass Moment of Inertia (Ix) ($in^4$) | 7.27 | 1.97 | 2.39 | 1.97 |
| Maximum Bending Moment (in. lb) | $1.4 \times 10^5$ | $2.56 \times 10^4$ | $2.99 \times 10^4$ | $2.56 \times 10^4$ |
| Maximum Torque Capacity (in. lb) | $124 \times 10^3$ | $3.54 \times 10^3$ | $4.16 \times 10^3$ | $3.54 \times 10^3$ |

As can be seen in the table provided above, the construction of blade 12 greatly enhances the mass moment of inertia, the maximum bending moment, and the maximum torque capacity board 12 can withstand as compared to known board constructions.

During operation of the portable vibratory screed 10, blade 12 is moved in a direction or a screeding direction, indicated by arrow 58 (FIG. 3), across a material to be leveled, struck off or floated. When an operator desires to increase an elevation, or raise a grade, handlebar 28 is rotated upward, thereby allowing more material to pass under leading edge 60. Conversely, when an operator desires to lower an elevation, or cut the grade, rotation of handlebar 28 downward lowers leading edge 60, thereby decreasing the elevation of the finish material. Positioning of a leading edge 60 of blade 12 thus is controlled by an operator's manipulation of handlebar 28.

The trailing edge 62 of blade 12 "floats" the material, and thereby closes a surface structure of the material. That is, as blade 12 moves across the surface of the wet concrete, blade 12 forces the larger aggregate below the finish surface of the material and raises the cream of the material.

A plurality of grab bars 46 are attached to the upper surface of the blade in a spaced-apart relationship. Grab bars 46 are constructed and configured to provide for efficient lifting and/or transporting of portable vibratory screed 10 by operators thereof or auxiliary equipment, such as lifts, skid loaders, cranes, or the like. Understandably, the portable nature of screed 10 means that the screed can be operated and transported with a minimum of manpower.

Figure 2:
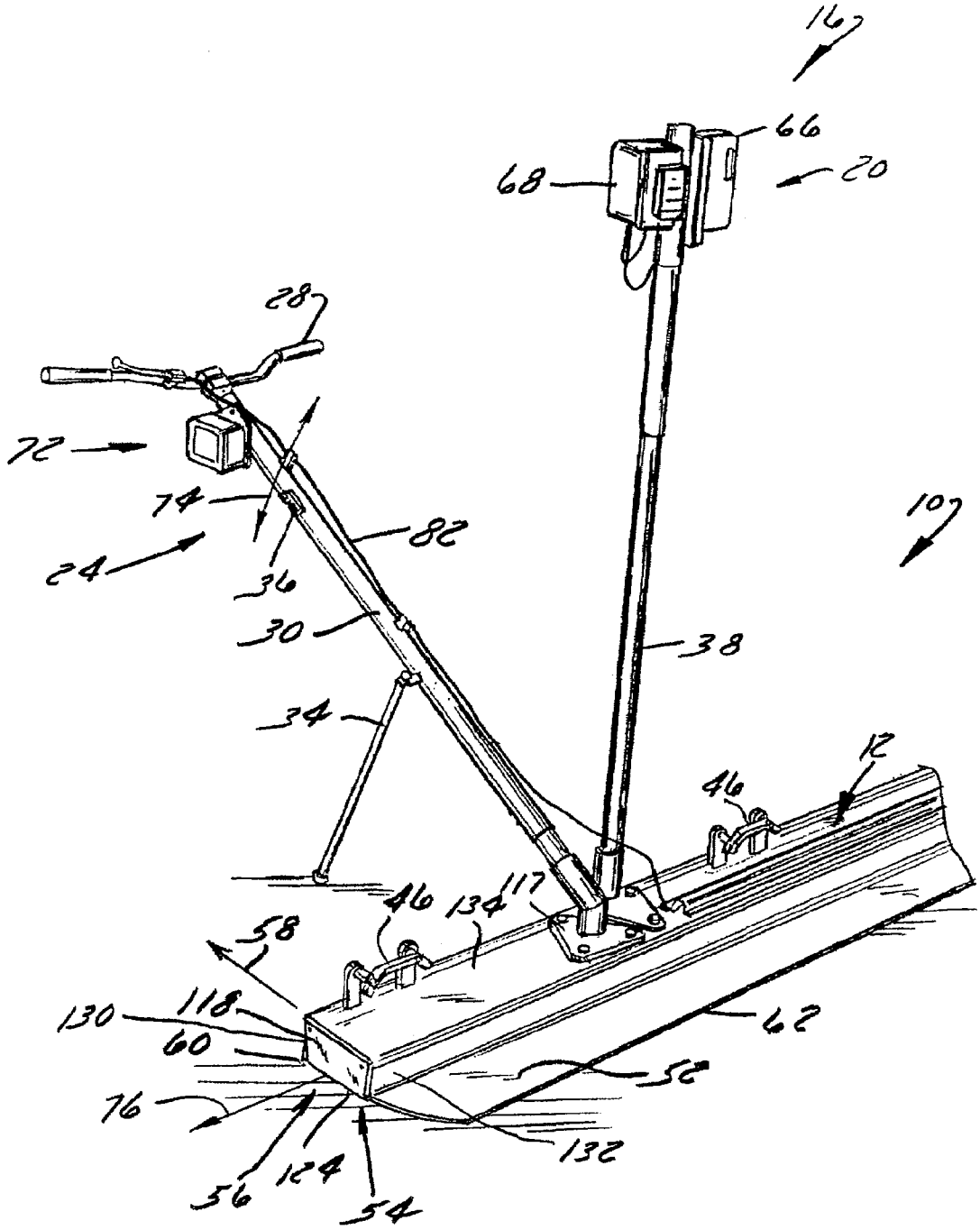
FIG. 2 is an isometric view of one of the operator positions of the portable vibratory screed shown in FIG. 1.
Figure 3:
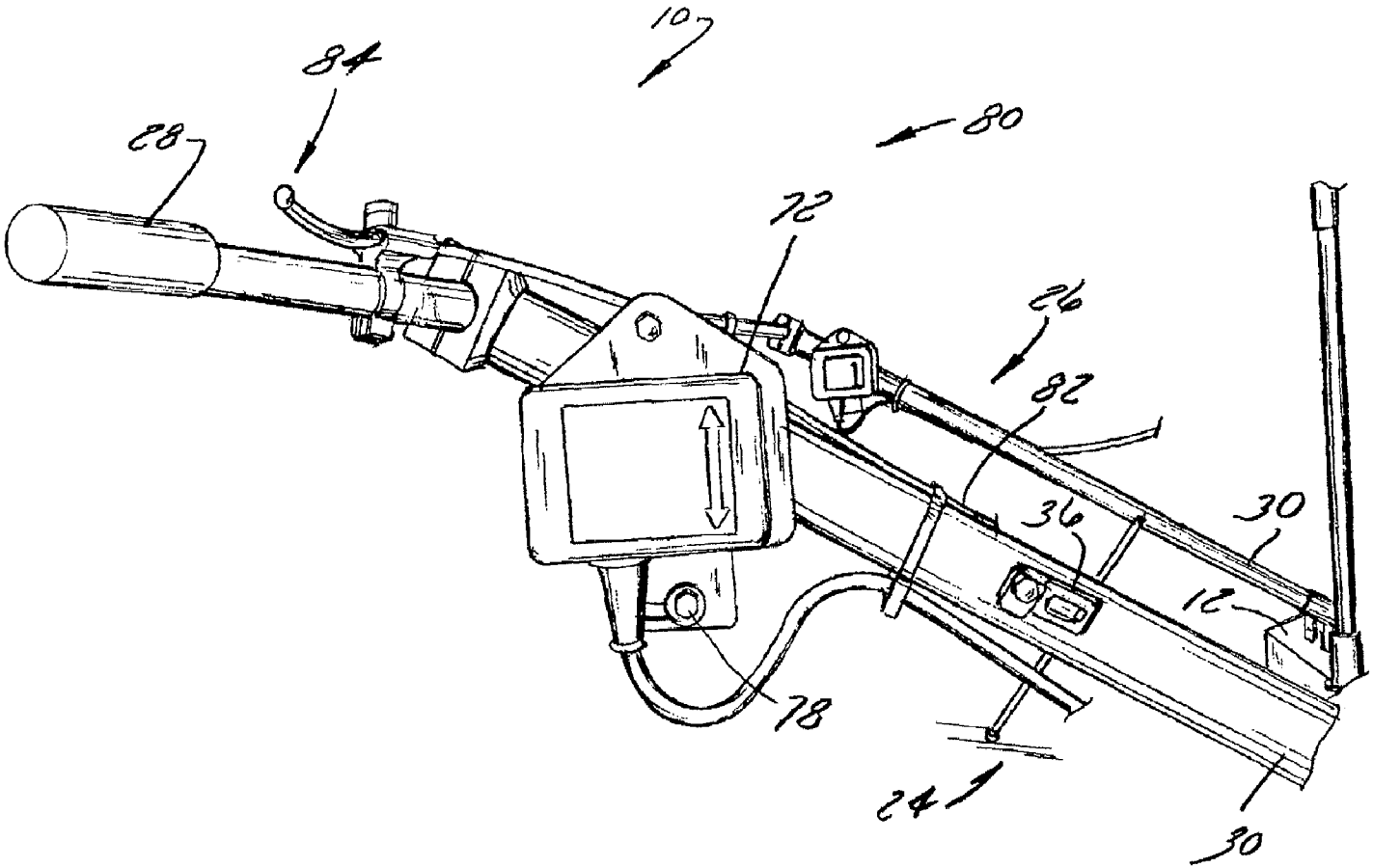
FIG. 3 is a side elevational view of a portion of the operator control position shown in FIG. 2.

Referring to FIGS. 2 and 3, laser leveling systems 20 and 22 are generally identical. System 20 will now be described, it being evidenced that the description applies equally to system 22. As shown in FIG. 2, laser leveling system 20 is attached to blade 12 via a mast mount 42 and a telescopic mast 38. Telescopic mast 38 provides a variable distance between laser leveling system 20, 22 and blade 12. Telescopic masts 38 each include a first end 40 that is received within a mast mount 42 rigidly connected to blade 12. Laser leveling system 20 includes a receiver 66 operatively connected to a control 68. Preferably, receiver 66 and control 68 are operable to provide an inclination indication of blade 12 during a leveling process.

In one embodiment, receiver 66 preferably takes the form of a laser sensor eye that acts in conjunction with an off-blade fixed reference laser or transmitter 67 (FIG. 1) that projects a laser beam at a predetermined reference height. The reference laser preferably is a 360 degree laser that creates a plane-like laser projection so that the eye can receive the reference signal from any location. Preferably, the laser sensor eye also has a 360 degree receiving means so that it can receive the reference laser signal without having to be turned towards the reference laser as the screed is used in different locations on the jobsite. Laser sensor eyes and reference lasers are well known in the art.

In operation, the reference laser sends a 360 degree signal that is received by the laser sensor eye. The laser sensor eye indicates to the operator whether it is above, below, or level with the reference signal, and the operator can make adjustments accordingly to ensure that the laser sensor eyes stays at the proper level.

As best shown in FIGS. 2 and 3, an inclination sensor 72 connected to handle tube 30 proximate handlebar 28. Inclination sensor 72 is constructed to communicate the degree of rotation, indicated by arrow 74, of handlebar 28 relative to an axis, indicated by arrow 76, of blade 12. The operative association of inclination sensor 72 upon handle assemblies 24, 26 and receiver 66 and control 68 of laser leveling system 20 ensures that, during operation of portable vibratory screed 10, laser leveling system 20 adjusts its output so as not to be influenced by operator rotation 74 of handlebar 28 relative to axis 76. The inclination sensor may comprise an electronic inclinometer mounted in any orientation that allows it to measure the fore-aft inclination of the screed in the plane orthogonal to the blade's long axis.

As shown in FIG. 3, in one embodiment, a mounting bracket 78 secures inclination sensor 72 to handle tube 30 proximate in operator end 80 of handle assembly 24. Such an orientation ensures that laser leveling system 20 is responsive to relatively small deflections in the position of handlebar 28 relative to blade 12. Mounting bracket 78 may be adjustably mounted on handle tube 30 so that can be set to provide a zero reading (i.e. the inclinometer is parallel to the ground) when the screed 10 is at the desired operating inclination. Such a mounting position provides the operator with a simple reference point for maintaining the inclination of the screed.

Figure 4:
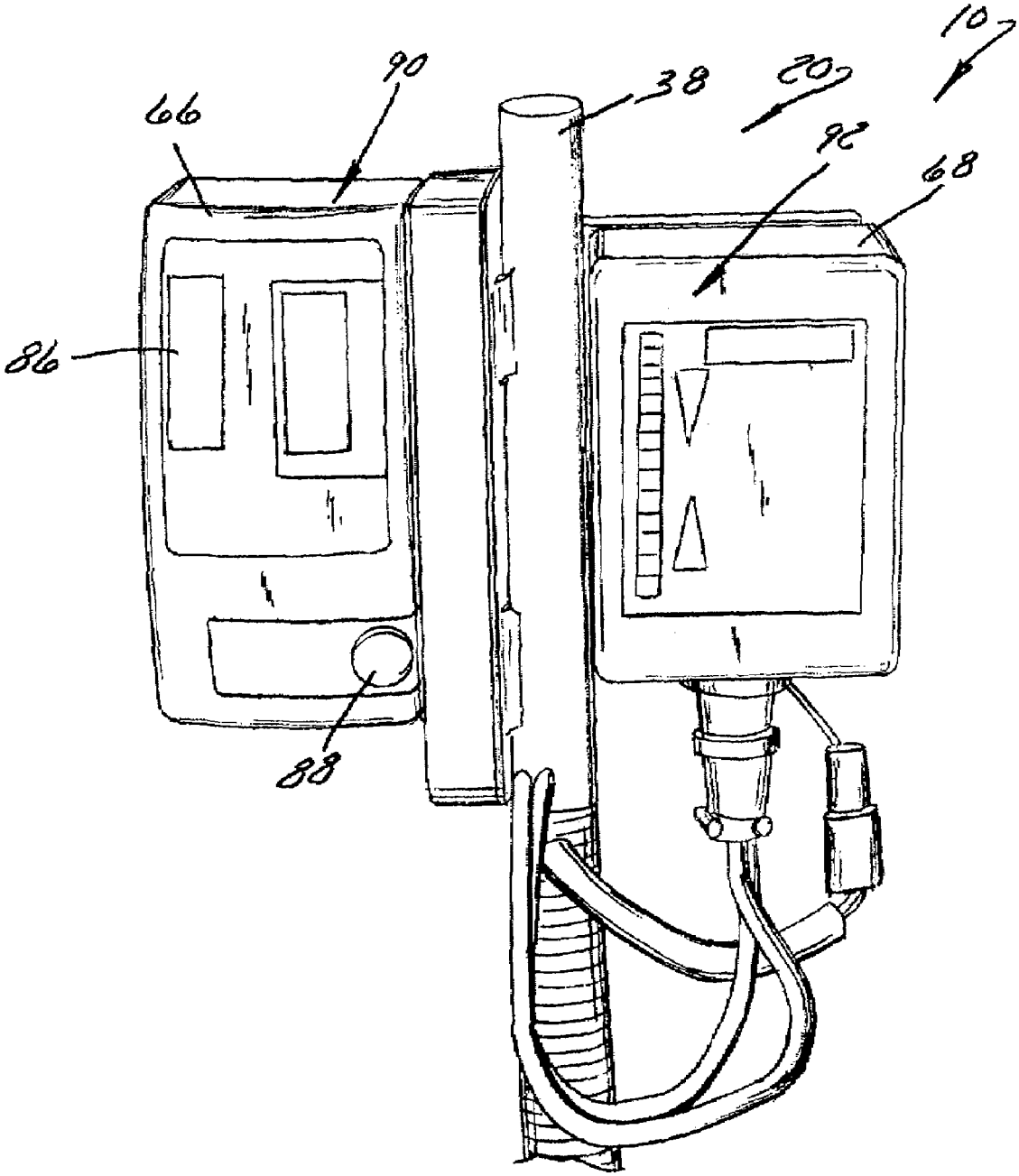
FIG. 4 is an elevational view of one set of the based-mounted components of the laser leveling system of the portable vibratory screed shown in FIG. 1.

As shown in FIG. 4, laser receiver 66 includes a reception window 86 constructed to receive a laser signal indicative of a desired elevation of blade 12 and an ON/OFF, adjustment switch 88. Controller 68 is attached to telescopic mast 38 and operatively connected to inclination sensor 72, as shown in FIG. 3. Receiver 66 and control 68 each include an output display 90, 92 configured to provide an indication of the relative elevation of blade 12. That is, during operation, outputs 90, 92 provide an optical, acoustical, or vibratory alert and/or signal to an operator of portable vibratory screed 10, thereby indicating to the operator whether the finished surface of the material being traversed is at a desired elevation. An indication from laser leveling system 20 that the elevation is too high would indicate to an operator that the handle should be rotated down to remove material from the finished surface, and an indication that the elevation is below a desired elevation indicates to an operator that the handle needs to be raised to allow more material to pass under blade 12, thereby raising the elevation of the finished surface. Equipping each operator station 16, 18 with a laser leveling system 20, 22, respectively, allows each of the operators to independently determine and adjust the relative positioning of blade 12 to the finished material such that a desired elevation and/or inclination is maintained throughout a pouring process. The b-shaped cross-section of the blade 12 resists undesired bending or twisting at this time, but not so much as to prevent operators from intentionally bending or twisting the blade 12 sufficiently to adjust the grade or level of the material engaged by one end of the blade relative to the material engaged by the other end of the blade.

Other details of a laser leveling system applicable to the present invention are disclosed in Published U.S. Patent Application No. 2004/0071509, the subject matter of which is hereby incorporated by reference in its entirety.

A throttle cable 82 extends along handle tube 30 and is connected to a throttle lever 84 connected to handlebar 28. Such a configuration allows an operator of portable vibratory screed 10 convenient and expedient manipulation of the operation of the vibration mechanism 14 shown in FIG. 1. Both handle assemblies 24, 26 could be configured to allow adjustment of the vibration mechanism 14 by either operator of the portable vibratory screed 10.

Figure 5:
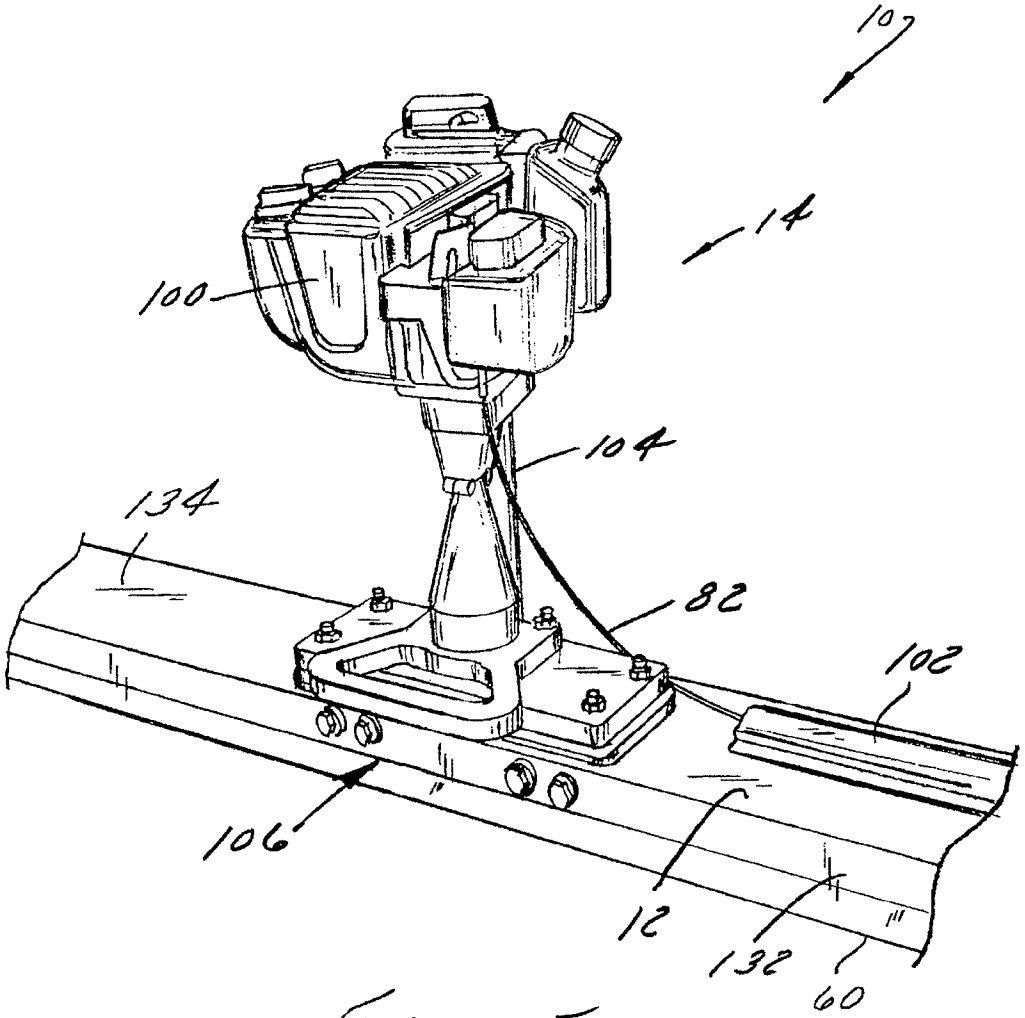
FIG. 5 is a perspective view of the vibration system of the portable vibratory screed shown in FIG. 1.

FIG. 5 shows a perspective view of the vibration mechanism 14 of the portable vibratory screed 10. As best seen in FIG. 5, vibration mechanism 14 includes an engine 100 operatively connected to throttle cable 82. A shroud 102 is attached to blade 12 and protects throttle cable 82 from exposure to concrete material that may spatter over blade 12 during a concrete pour. A pedestal 104 elevates engine 100 above blade 12 and allows placement of an exciter assembly 106 therebetween. Exciter assembly 106 is constructed such that, during operation of engine 100, rotation of one or more eccentric masses (not visible) impacts vibrations to blade 12. The vibration of blade 12 consolidates and levels a material passed thereunder. Engine 100, pedestal 104, and exciter assembly 106 are constructed to isolate the undesired vibration of engine 100 and blade 12. Other details of the vibration arresting construction of the mounting assembly are disclosed in allowed U.S. patent application Ser. No. 10/773,012, the subject matter of which is incorporated by reference in its entirety.

Figure 7:
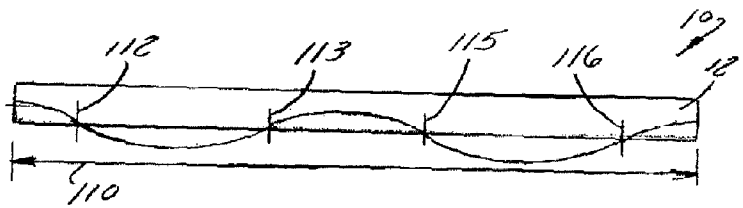
FIG. 7 is a schematic representation of the vibration of the portable vibratory screed shown in FIG. 1.

The vibration mechanism 14 is positioned proximate a center of blade 12 and induces a sinusoidal vibrational wave in the blade 12 as shown at 113 in FIG. 7. The sinusoidal wave includes a plurality of points, or nodes, where the amplitude of the vibration of blade 12 is at a minimum. These minimal or minimum vibrational nodes are spaced along the length of blade 12 in both directions from vibration mechanism 14. For a given screed design, the number of nodes and the location of each node depend upon the driven speed of the exciter, which can be considered to be the same as the engine output speed. During most periods of operation, the engine will drive the exciter at a "rated operating speed" that is designed to be employed except in unusual conditions. The rated operating speed may be that which is obtained when the throttle is fully engaged and may be near but below the engine's maximum RPM. In the illustrated example, four "rated operating nodes" 112, 113, 115, and 116 of minimal vibrational amplitude are spaced along the length of a 14' blade when the engine is operated at the exciter's rated operating speed of about 7,500 RPM. The nodes are formed in a first pair (112, 113) and a second pair (115, and 116) disposed symmetrically about the center of the blade 12. The outer node 112, 116 and inner node 113 and 115 of each pair are located 16.8" and 64.8", respectively, from the respective outer end of the blade 12.

Figure 6:
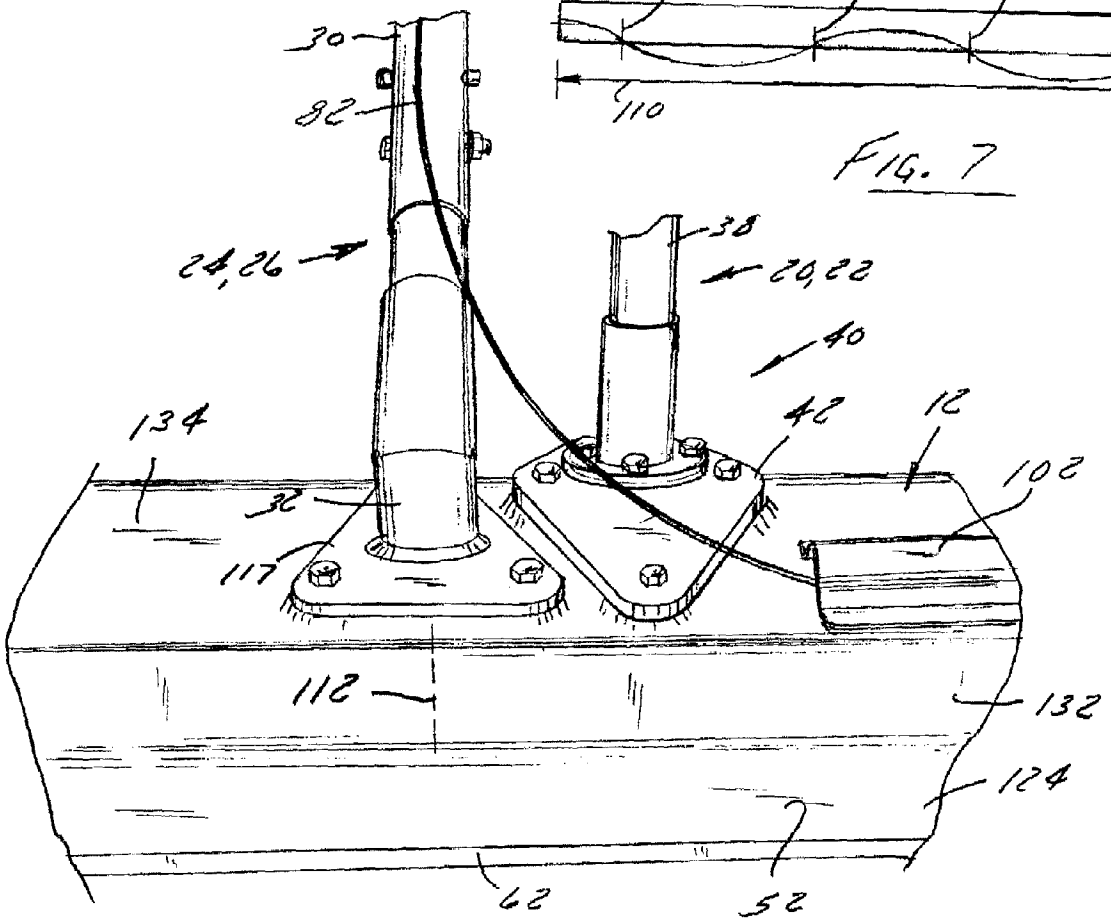
FIG. 6 is an isometric view of a vibrational node of the portable vibratory screed shown in FIG. 1.

As shown in FIGS. 6 and 10, handle mount bracket 32 and mast mount 42 are each mounted at, or in the vicinity of, a node obtained at a designated exciter drive speed, preferably at or near a rated operating node 112, 116 obtained at the rated exciter drive speed. Attaching laser leveling systems 20, 22, 150 and handle assemblies 24, 26, 162 proximate one of the rated operating nodes of blade 12 eliminates the necessity of having a vibration isolation system disposed between the connection of laser leveling system 20, 22 and/or handle assembly 24, 26 and blade 12. That is, rather than providing an isolative bushing within the connection assembly of the handle or the laser guidance system, the position of the connection of the handle assemblies 24, 26, 162 and/or the laser leveling systems 20, 22 or leveling system 150 along the length 110 of the blade 12 is determined and selected as a point of low vibration of blade 12 during normal operation of portable vibratory screed 10. A rigid mounting plate 117 for the handle 24 or 26 can then be bolted or otherwise affixed directly to the top plate 134 of blade 12 as seen in FIG. 6. Such a construction reduces the number of parts of the portable vibratory screed 10 and simplifies the assembly thereof. Furthermore, such a construction improves the control and steerability of portable vibratory screed 10.

Figure 11:
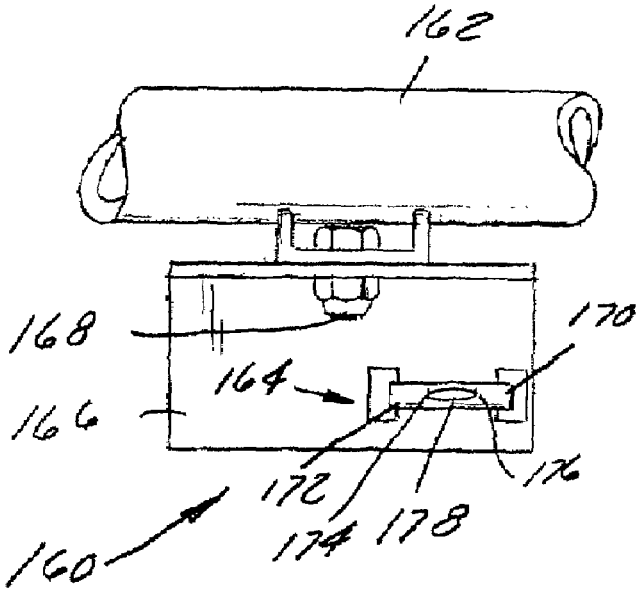
Figure 12:
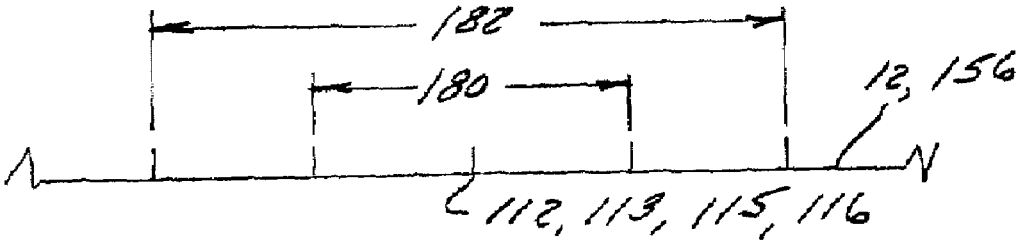

FIGS. 10-12 show an alternate embodiment of a leveling system 150 for use with portable screed 10 that also takes advantage of the fact that the sinusoidal vibrational wave has rated operating nodes 112, 113, 115, and 116 of minimal vibrational amplitude. Understandably, although only one leveling system 150 is shown, screed 10 could be provided with more leveling systems 150 depending on the number of operator positions associated with screed 10. Similar to leveling systems 20, 22, leveling system 150 includes a receiver 152 operationally connected to a controller 154 and configured to communicate to an operator the elevational position of a blade 156. An extendable mast 158 connects receiver 152 and controller 154 to blade 156. An inclination indication system 160 is attached to blade 156 either directly or, as in the present embodiment, via a handlebar 162, 162'. Inclination indication system 160 includes a site level or bubble via 164, 164' attached to handlebar 162 via a mount or pivot plate 166, 166'. Pivot plate 166 is connected to handlebar 162 via pivot 168 and configured such that the orientation of plate 166 can be fixed relative to blade 156. As shown in FIG. 11, bubble vial 164 includes a housing 170 having a volume of fluid 172 and a bubble 178 enclosed therein. Housing 170 includes a number of references lines 174, 176 that indicate the relative pitch of bubble vial 164. That is, having fixed the orientation of bubble vial 164 relative to the levelness of blade 156, an operator can readily assess the fore and aft inclination of blade 156 through visual inspection of bubble vial 164. The position of bubble 178 relative to reference lines 174, 176 communicates the inclination of blade 156 to an operator. The degree with which bubble 178 crosses line 174 indicates an upward rotation of handle assembly 162, thereby allowing more material to pass under blade 156. Inversely, the degree with which bubble 178 crosses line 176 indicates a downward rotation of handle assembly 162 thereby indicating the performance and degree of a material cuffing or grade dropping operation. Maintaining bubble 178 between lines 174, 176 when the bubble 178 is calibrated to be aligned with blade 156 indicates a level movement of screed 10 across a pour material. Accordingly, inclination system 150 provides a versatile and dynamic indication of the degree of inclination of blade 156.

Because the site level is mounted (at least indirectly) at or near a minimal vibrational mode 112, 113, 115, or 116 that is not subjected to high vibrations, the integrity of bubble 178 throughout the operational range of screed 10. That is, even during operation of the screed, bubble 178 is maintained as a relatively uniform gas cavity within fluid 172 such that bubble 178 can be readily viewed by an operator.

Understandably, the handles 24, 26, and/or site levels 164, 164' mounted via mounting or pivot plates 166, 166' associated with each of handlebars 162, 162' could be offset from the respective rated operating node without additional vibrational consideration. That is, in that embodiment equipped with bubble vial inclination system 160, 160' (FIG. 11) mounted on nodes 112, 116 spaced 427 mm from the ends of the blade 12, the bubble vial inclination system 160 could be connected to blade 12 within a first range 180 generally defined as the distance offset from either side of the node along blade 12 by a distance of no more that approximately 50-75 mm. This distance corresponds to the distance that bubble vial inclination system 160, 160' can be moved from the respective rated operating node 112 or 116 and maintain bubble integrity at the rated operating speed of the engine.

A second range 182 includes distances that are further from the node than first range 180. Second range 182 indicates the distance that bubble vial inclination system 160 can be offset from attachment to blade 12 and remain operable through the use of a shock arresting bushing or the like. Second range 182 is generally defined as the distance offset from either side of the rated operating node along blade 12 by a distance of no more than approximately 100-150 mm). Preferably, bubble vial inclination system 160 is attached to blade 12 within first range 180 relative to a node.

Various alternatives are contemplated as being within the scope of the following claims particularly pointing out and distinctly claiming the subject matter regarded as the invention.

What is claimed is:

1. A portable vibratory screed comprising:

a blade for flattening a material;

an exciter that is rotatable and that, when driven at a designated rotational speed, induces a vibrational wave in the blade having amplitude minima located at nodes spaced longitudinally from one another on the blade; and at least one of a handle and a site level rigidly mounted on the blade at or in the vicinity of the location of one of the nodes.

2. The portable vibratory screed of claim 1, wherein the at least one of a handle and a site level is a handle that is mounted on the blade at or in the vicinity of one of the nodes.

3. The portable vibratory screed of claim 2, wherein the handle is rigidly connected to the blade.

4. The portable vibratory screed of claim 2, further comprising a site level that is attached to the handle.

5. The portable vibratory screed of claim 2, further comprising another handle mounted on the blade at or in the vicinity of another node and another site level attached to the screed proximate the another handle.

6. The portable vibratory screed of claim 5, wherein the second site level is attached to the second handle.

7. The portable vibratory screed of claim 4, further comprising a mounting bracket that supports the site level on the handle and that is movably connected to the screed to calibrate an orientation of the sight level relative to the blade.

8. The portable vibratory screed of claim 1, further comprising a laser level system that indicates an elevation of the blade.

9. The portable vibratory screed of claim 1, wherein the blade is reinforced at at least a leading portion thereof to resist bending or twisting.

10. The portable vibratory screed of claim 9, wherein the blade has a transverse cross-sectional shape that is at least generally similar to a lower-case letter b.

11. A portable vibratory screed comprising:

a blade;

an exciter that is rotatable and that, when driven at a designated rotational speed, induces a vibrational wave in the blade having amplitude minima located at nodes spaced longitudinally from one another along the length of the blade; and first and second longitudinally spaced handles each of which is rigidly mounted directly on the blade at or in the vicinity of one of the nodes and each of which is constructed to be manipulated by a separate operator; and first and second site levels each of which is mounted on a respective one of the handles and each of which is configured to indicate blade pitch during vibration of the blade.

12. The portable vibratory screed of claim 11, further comprising first and second mounting brackets each of which pivotally supports a respective site level on a respective handle to allow calibration of the site level relative to a position of the blade.

13. The portable vibratory screed of claim 11, further comprising a laser leveling system having a transmitter configured to be remotely located relative to the blade and a receiver constructed to be attached to the portable vibratory screed and communicate with the transmitter to indicate an elevation of a pour material.

14. The portable vibratory screed of claim 11, wherein the blade is reinforced at at least a leading portion thereof to resist bending or twisting.

15. The portable vibratory screed of claim 14, wherein the blade has a transverse cross-sectional shape that is at least generally similar to a lower-case letter b.

16. A method of forming a portable screed comprising:

providing a blade;

mounting an exciter assembly having a rotary actuator on the blade;

determining the locations of nodes of minimum vibrational amplitude that are formed along a length of the blade when the exciter assembly is operated at a designated rotational speed; and rigidly supporting at least one of an operator's handle and a site level on the blade in the vicinity of one of the nodes.

17. The method of claim 16, wherein the supporting step comprises rigidly attaching the handle to the blade and mounting the site level on the handle.

18. The method of claim 17, further comprising supporting a second handle and a second site level on the blade in the vicinity of another one of the nodes.

* * * * *